US005651178A

United States Patent [19]

Sasse et al.

[11] Patent Number: 5,651,178

[45] Date of Patent: Jul. 29, 1997

[54] SEMI-AUTOMATIC IDC TERMINATION MACHINE

[75] Inventors: Tilo Sasse, Berlin; Manfred Liedloff, Dieburg, both of Germany

[73] Assignee: The Whitaker Corporation, Wilmington, Del.

[21] Appl. No.: 560,158

[22] Filed: Nov. 20, 1995

[30] Foreign Application Priority Data

Nov. 25, 1994 [GB] United Kingdom ..... 9423878

[51] Int. Cl.[6] ..... H01R 43/052; H01R 43/28

[52] U.S. Cl. ..... 29/753; 29/33 M; 29/755; 29/866; 72/712

[58] Field of Search ..... 29/33 M, 564.4, 29/566.4, 749, 751, 753, 755, 759, 865, 866; 7/107; 72/413, 409.6, 409.14, 712

[56] References Cited

U.S. PATENT DOCUMENTS

| | | | |
|---|---|---|---|
| 3,742,571 | 7/1973 | Brehm | 29/751 X |
| 4,085,497 | 4/1978 | Nijman et al. | 29/751 X |
| 4,467,516 | 8/1984 | John et al. | 29/566.4 |
| 4,627,150 | 12/1986 | Burnett | 29/566.4 |
| 4,642,874 | 2/1987 | Litehize, Jr. | 29/749 X |
| 4,870,747 | 10/1989 | Maack et al. | 29/755 X |
| 5,432,995 | 7/1995 | Takenami et al. | 29/753 |

*Primary Examiner*—Peter Vo

[57] ABSTRACT

An IDC termination machine comprises opposed spring loaded gripper pads for clamping and a wire to be terminated in alignment with a corresponding IDC section of a connector. One of the gripper pads is connected to an arm having a camming protrusion that cooperates with a stuffer member. During pulling of the wire between the gripper pads, the gripper pads are biased apart such that the wire can be brought without resistance as close as possible to the connector. Termination is then actuated, and advance movement of the stuffer cams the protrusion into a recess of the camming plate. The gripper pad thus clamps the wire against opposing gripper pad just prior to cutting and termination.

10 Claims, 13 Drawing Sheets

SEMI-AUTOMATIC IDC TERMINATION MACHINE

BACKGROUND OF THE INVENTION

1. Field of the Invention

This invention relates to an IDC termination machine that terminates wires to an IDC connector in a semi-automatic manner, the invention more particularly relating to gripper members that hold the wire just prior to stuffing into IDC contacts.

2. Description of the Prior Art

FIGS. 1 and 2 show examples of an IDC connector 2 comprising an insulative housing 4 having cavities 6 therein for mounting of stamped and formed electrical terminals 8. The electrical terminals 8 have a contact section 10 for mating with complementary contacts of a complementary connector, and an IDC (insulation displacement contact) section 12 for connection to insulated conducting wires 14 of a cable 16. Interconnection of the wire 14 to the IDC contact section 12 is produced by stuffing the wire into IDC slots 18 of the IDC contact section which cuts through the insulative layer of the wire 14 thus making electrical contact with the inner conducting strands thereof.

Semi-automatic termination of the wires 14 to the terminals 8, is done by positioning the connector 2 on a support of a termination machine, and then positioning a wire 14 over the corresponding terminal by pulling the wire by hand between grippers of the termination machine that position the wire above the IDC terminal slot, the subsequent step being to insert a stuffer between the grippers and push the wire 14 into the IDC slots 18 of the terminal 8. The grippers are spring loaded and biased towards each other in such a manner to grip the wire such that it can be released and then end trimmed prior to actuation of the stuffer.

One of the problems with the prior art, however, is that the spring force in the grippers prevents the wire from being pulled very close to the IDC contact in the straightest possible manner from the end of the outer insulation 17 of the cable 16. In certain applications, it would be desirable to have a short a wire as possible extending from the lower end of the cable outer insulation 17. The latter is inhibited in the prior art by the frictional force of the grippers that cause the wire to bend when pulling the wire by hand therebetween, the wire therefore not being the shortest possible.

SUMMARY OF THE INVENTION

It is therefore an object of this invention to provide a wire termination machine that enables termination of multi-wire cable 16 for short lengths of wire that branch from the cable 16.

A further object of this invention is to provide an IDC termination machine that is cost-effective and reliable for terminating short lengths of wires extending from a cable.

The objects of this invention have been achieved by providing a connector termination machine for stuffing wires of a cable into IDC contacts of a connector, the machine having spring loaded grippers for gripping the wire to be terminated just prior to termination, characterized in that a gripper has a camming surface engageable against a camming surface of a stuffer member such that in a retreated position of the stuffer, the gripper is biased open for positioning of the wire proximate the IDC contact to be terminated, and upon movement of the stuffer member for stuffing the wire, the cam surfaces cooperate in a manner to allow the gripper member to clamp the wire just prior to stuffing thereof into the IDC contact.

DETAILED DESCRIPTION OF THE PREFERRED EMBODIMENT

Figure 3:
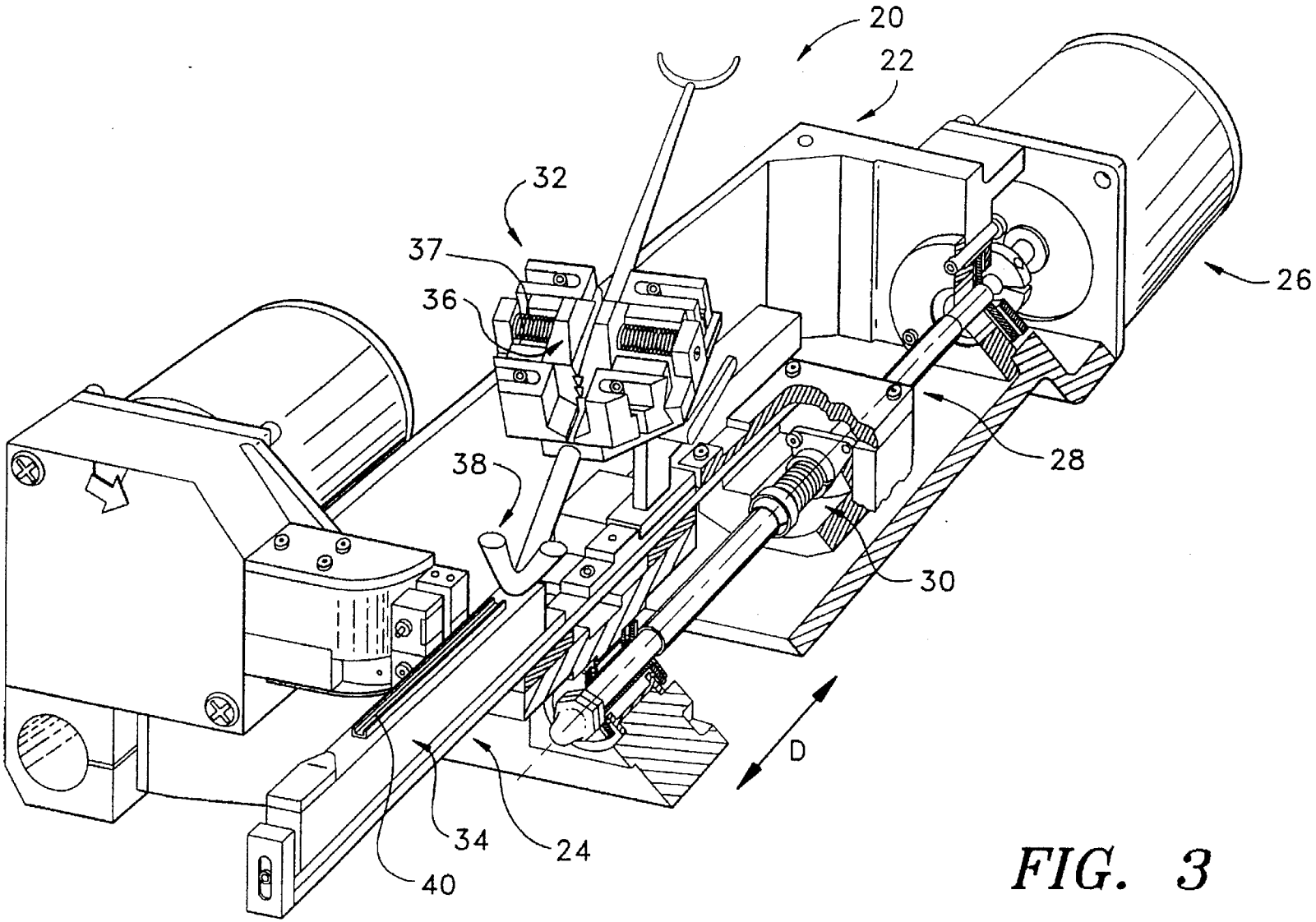
FIG. 3 is a partial cross-sectional isometric view of an IDC termination machine with some parts removed for clarity.

Referring to FIG. 3, part of an IDC termination machine (20) is shown, the other part being cut-away, the machine comprising a fixed support 22 and a movable member 24 that is movable in translation in the direction D by action of a motor 26 that rotates a threaded spindle 28 engaging a complementary threaded member 30 that is securely fixed to the movable part 24. The movable part 24 comprises a cable support 32 and a connector support 34. The cable support 32 comprises a pair of opposed grippers 36 that are resiliently biased together by springs 37 for gripping a cable 16 placed therebetween, the support 32 further comprising a rod support 38 for supporting the free end of the cable during termination.

The connector support 34 comprises a cavity 40 for receiving a mating end of a connector to be terminated such as the connector 2, and has a means for clamping the connector therein. IDC portions 12 of the connector project above the cavity 40 for termination (e.g. see FIG. 5*a*).

Figure 4A:
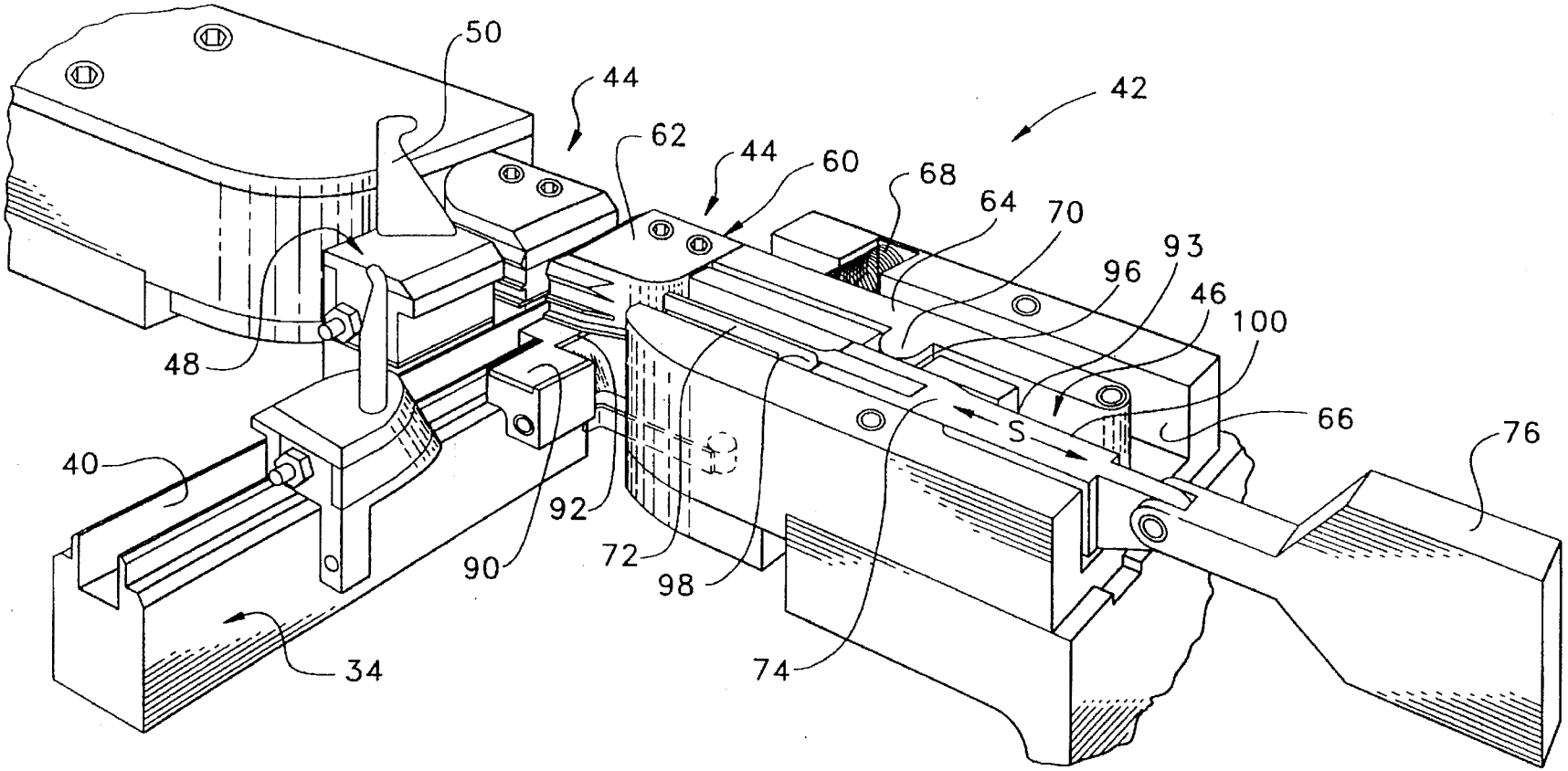
FIG. 4*a* is a partial isometric view showing cooperation of gripper and stuffer of the termination machine, but where a gripper pad is removed on one side of the machine for more clarity.
Figure 4B:
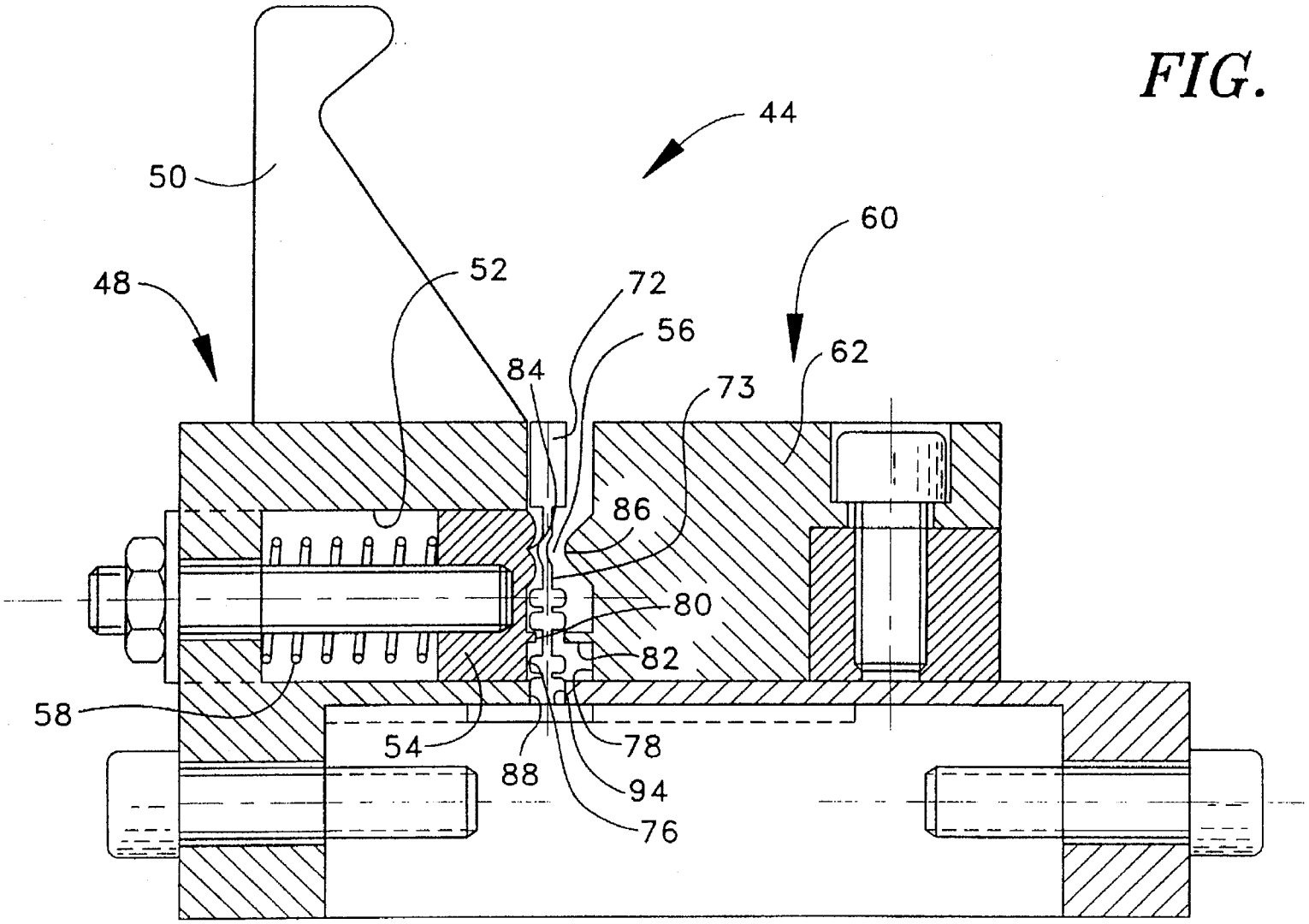
FIG. 4*b* is a cross-sectional view through the gripper members showing positioning of the stuffer member according to the position in FIG. 4*a;*

Referring to FIGS. 3, 4*a* and 4*b*, the machine 20 further comprises a termination device 42 having a gripper member 44 and a stuffer member 46. There are a pair of termination devices 42 disposed in mirror-image symmetry about the connector support 34 for terminating the connector 2 having IDC terminations on either side of the connector.

The gripper device 44 comprises a stationary member 48 having a finger 50 projecting upwardly and having a hooked upper end for catching a wire and guiding such wire between grippers, the stationary member 48 further comprising a guide 52 for slidably receiving a gripper pad 54 that is resiliently biased towards a wire receiving slot 56 by spring means 58. The gripper device 44 also comprises a movable gripper member 60 having a gripper pad 62 positioned opposite the gripper pad 54 to form the wire receiving slot 56 therebetween, and a support arm 64 pivotly attached at a far end from the gripper pad 62 to a housing member 66, whereby the pad 62 is biasable towards the opposed pad 54 by spring means 68. The gripper member 60 further comprises a camming protrusion 70 extending from the support arm 64.

Figure 1:
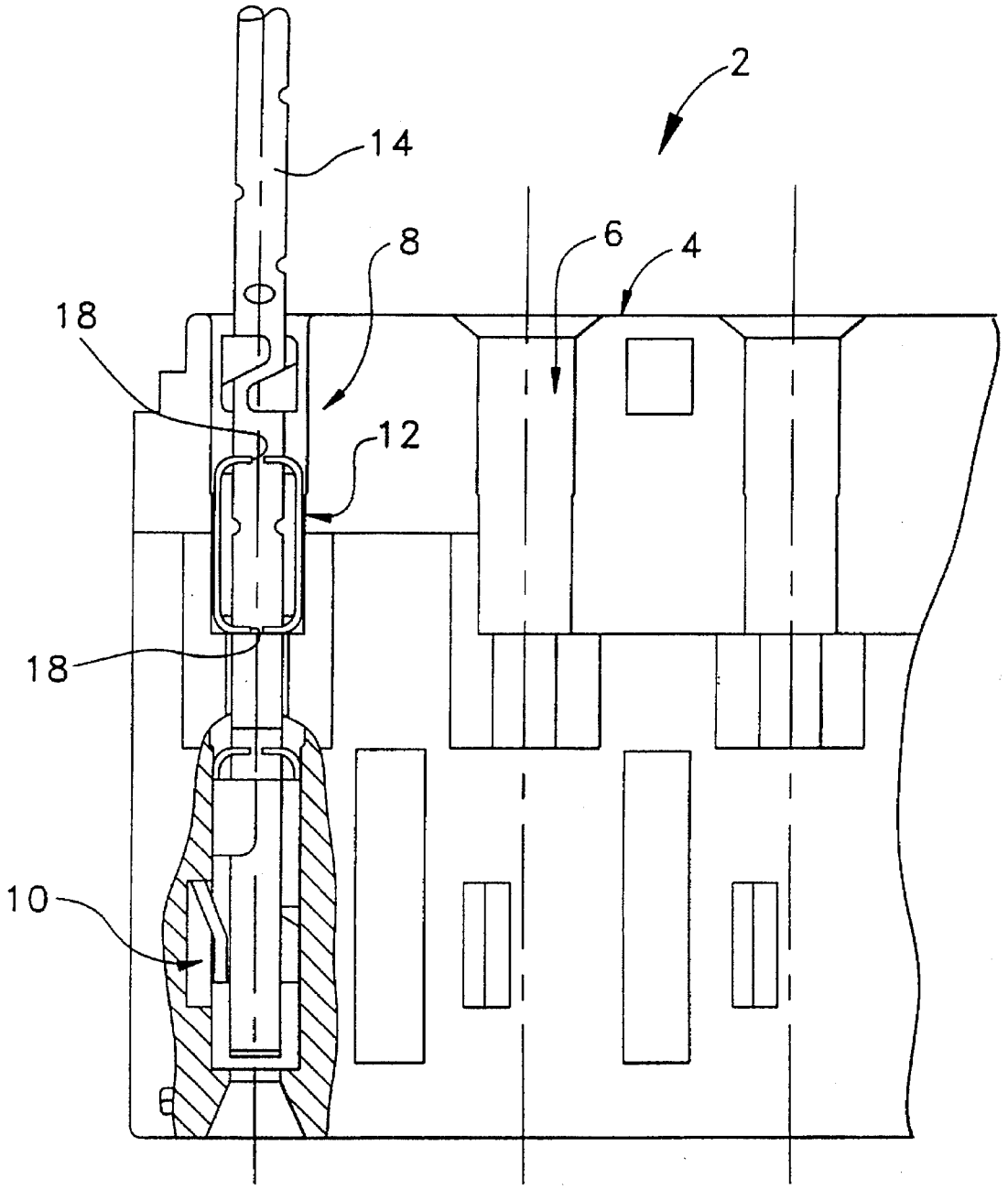
FIG. 1 ( PRIOR ART )
FIG. 1 is a partial side view with partial cross-section of a connector housing with IDC terminal mounted therein.
Figure 2:
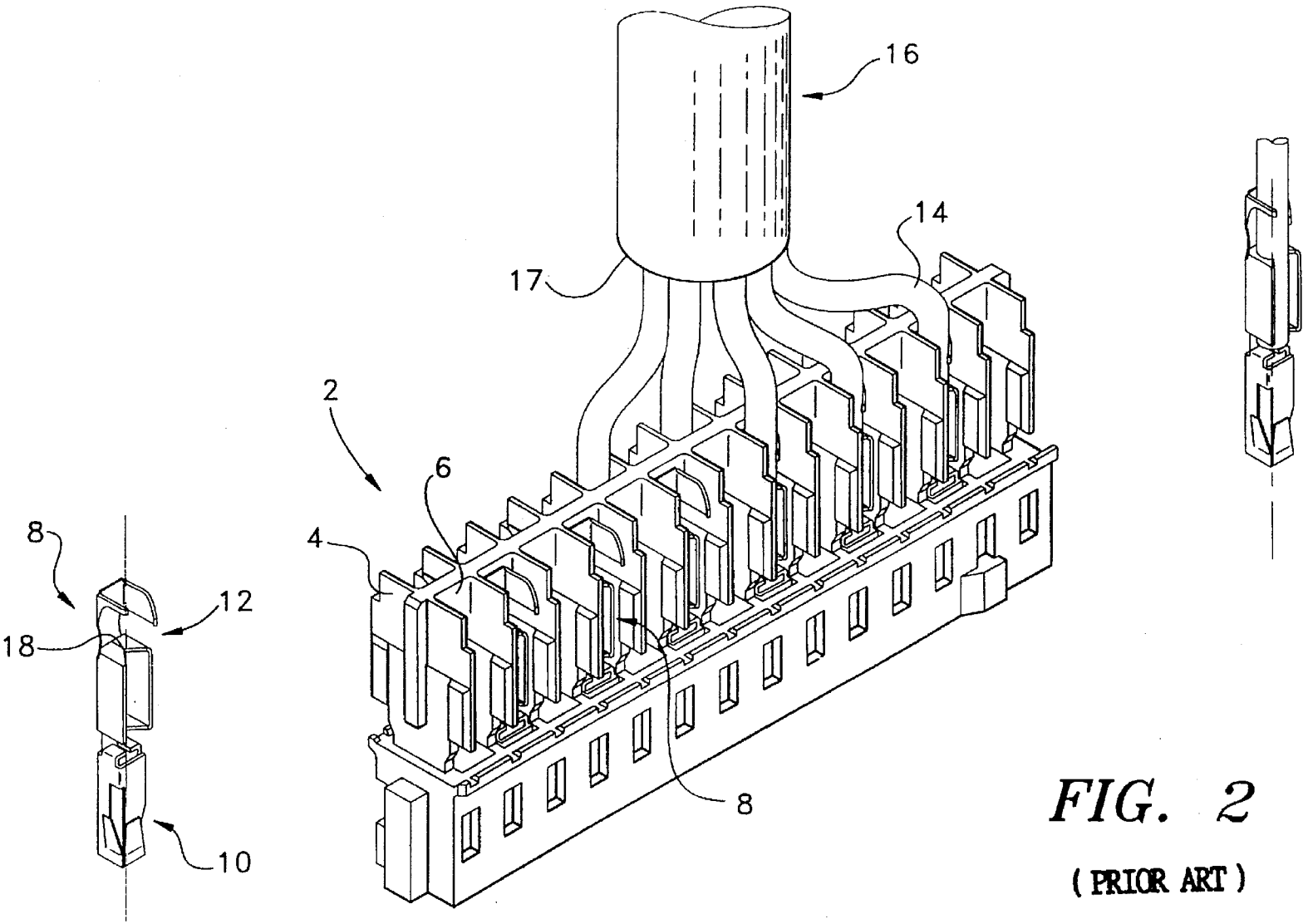
FIG. 2 (PRIOR ART)
FIG. 2 is an isometric view of an IDC connector terminated to wires of a cable, where a terminated terminal and an unterminated terminal have been taken out of the connector for clear illustration thereof.

The stuffer member 46 comprises a stuffer plate 72 attached to a camming plate 74 that is movable in a direction S perpendicular to the direction D, the movement being driven by a motor (not shown) connected to the camming plate 74 via a linkage mechanism 76. The stuffer plate 72 has a profile adapted to stuff a wire 14 into a corresponding terminal IDC section 12 by supporting the wire on either side of the IDC slots 18 (see FIG. 1). Thin sections of the profile 73 have a thickness less than the diameter of the wire to be stuffed such that the stuffer 72 is insertable between gripper faces 76,78 of the stuffer pads 54,62 respectively. A wire gripped between the pads 54,62 is thus gripped properly until stuffed into the IDC section 12.

The gripper pads 54,62 are provided with lower projections 80,82 respectively that grip a lower end of the wire 14, and further comprise a complementary groove 84 and projection 86 respectively for kinking the wire 14 between the pads for an improved grip thereon. The stuffer plate 72 is guided between the gripper pads 54,62 at a lower end by guide surfaces 88 that provide stability to the stuffer plate 72 during stuffing.

A cutting plate 90 is positioned below the gripper pads 54,62, spanning across the wire receiving slot 56 with a cutter edge 92 that is disposed close to the passage of the lower surface 94 of the stuffer plate 72.

The camming plate 74 comprises a camming surface 93 having a bulge 96 proximate a stuffer end 98 and, extending rearwardly therefrom, a recess 100. The gripper camming protrusion 70 cooperates with the stuffer camming surface 93 such that during movement of the stuffer member 46 in the direction S, the gripper pad 62 moves towards and away from the opposing gripper pad 54.

Figure 5A:
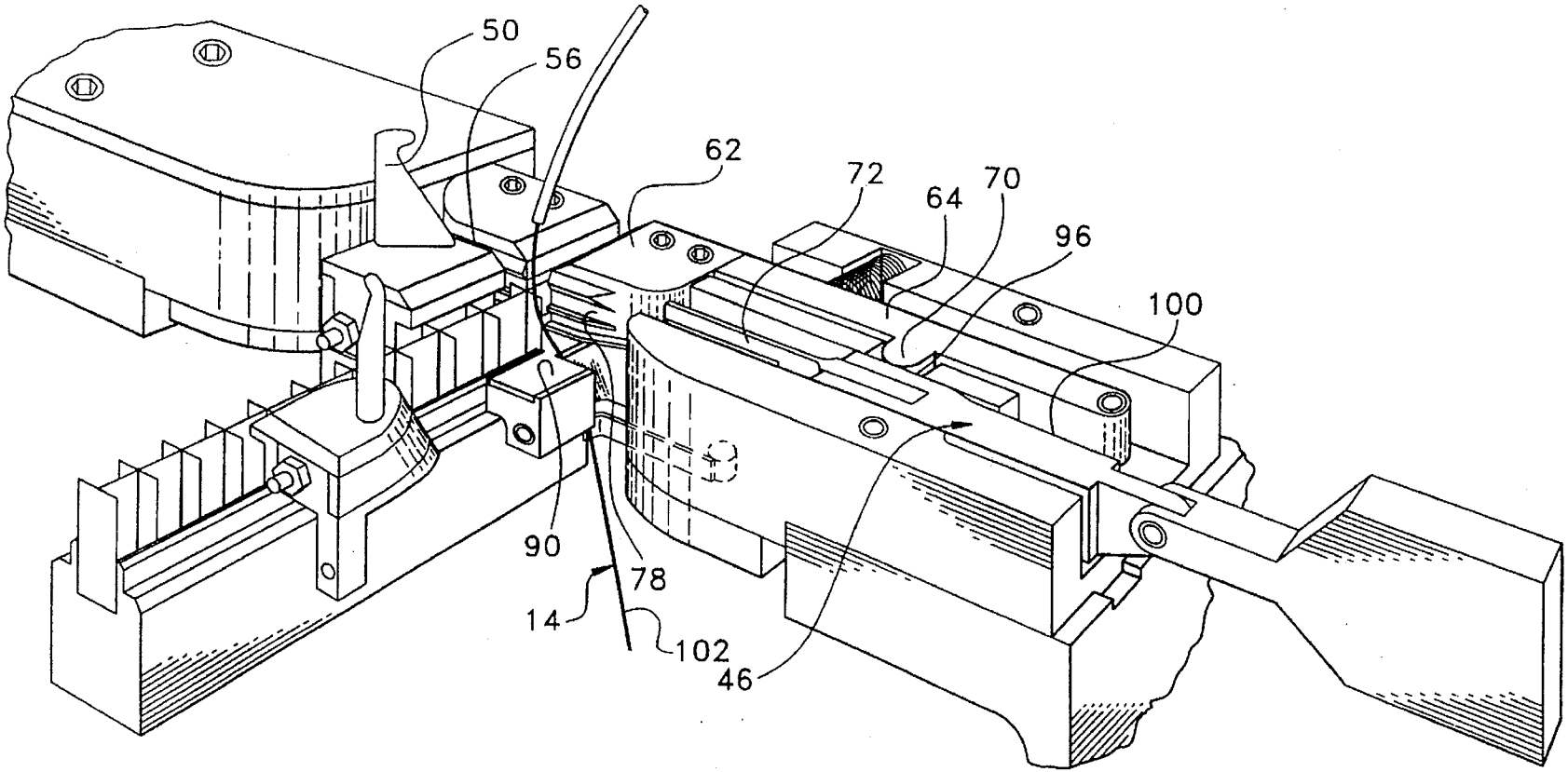
FIG. 5*a* is a similar view to FIG. 4*a* but showing a wire positioned between grippers prior to termination.
Figure 5B:
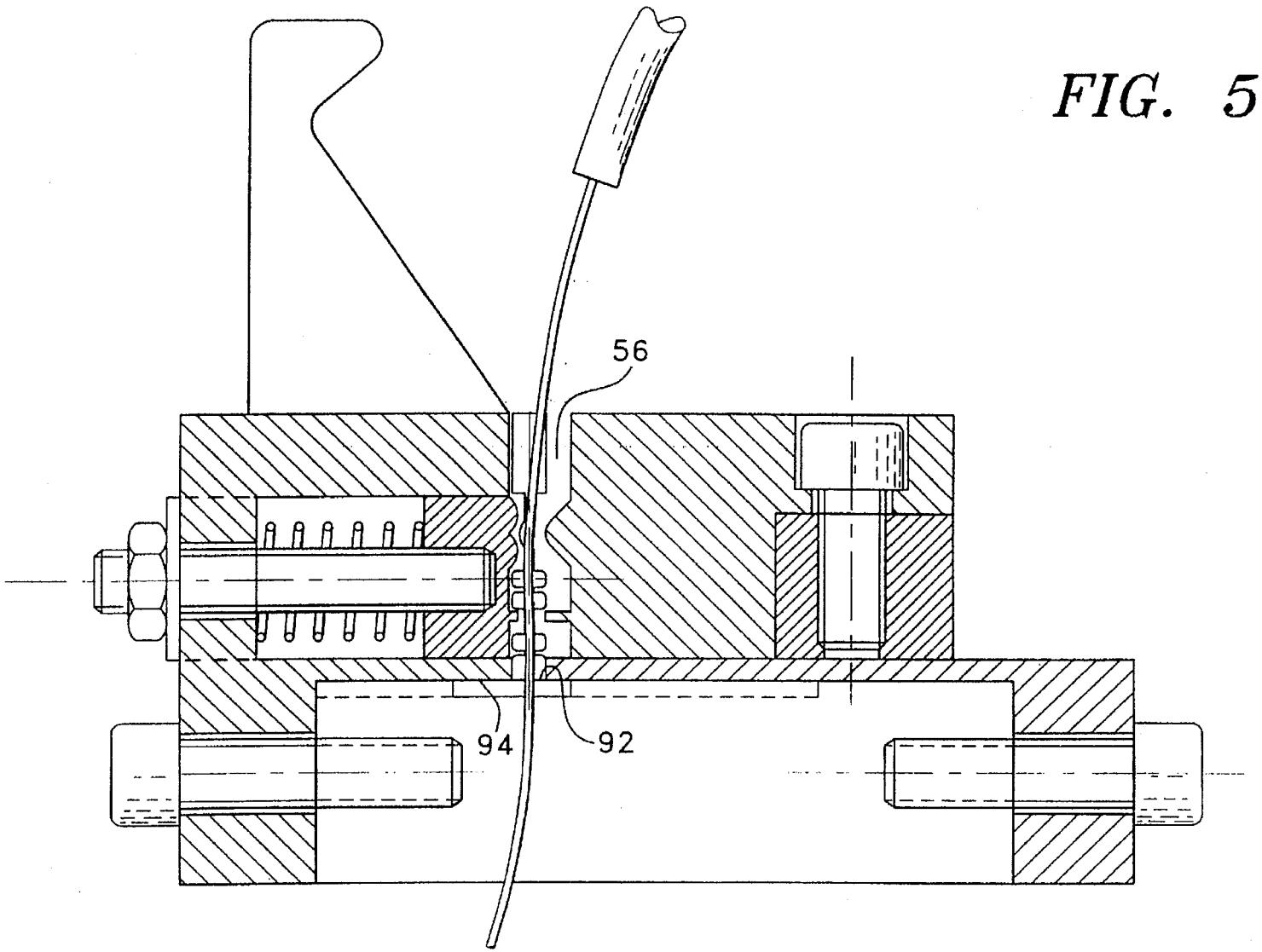
FIG. 5*b* is a cross-sectional view through FIG. 5*a* through the grippers in a similar plane to that of FIG. 4*b;*

Termination of a wire to an IDC section 12 of a connector 2 will now be explained with reference to FIGS. 5–8 where only one wire is shown for clarity and in FIGS. 4 to 8, one of the stationary gripper members 48 is not shown for more clarity. In FIGS. 5*a*, 5*b*, the stuffer member 46 is shown in a retreated position whereby the gripper camming protrusion 70 is biased against the bulge 96 of the camming surface 93 thereby biasing the gripper pad 62 away from the opposed gripper pad 54. In this position, a wire to be terminated 14 can be pulled into the wire receiving slot 56 which is wide enough to receive the wire without gripping the wire. The wire can thus be pulled (by gripping close to its free end 102) until the wire abuts the cutting edge 92 of the cutting plate 90. The cable 16 is supported on the support rod 38 and gripped by the cable grippers 36 such that the wires can be pulled without moving the cable. The selected wire 14 can then be pulled between the grippers 62,54 by first catching the wires against the finger 60 and pulling downwards whereby the finger 50 has a tapered surface to guide the wire initially between the gripper pads.

Figure 6A:
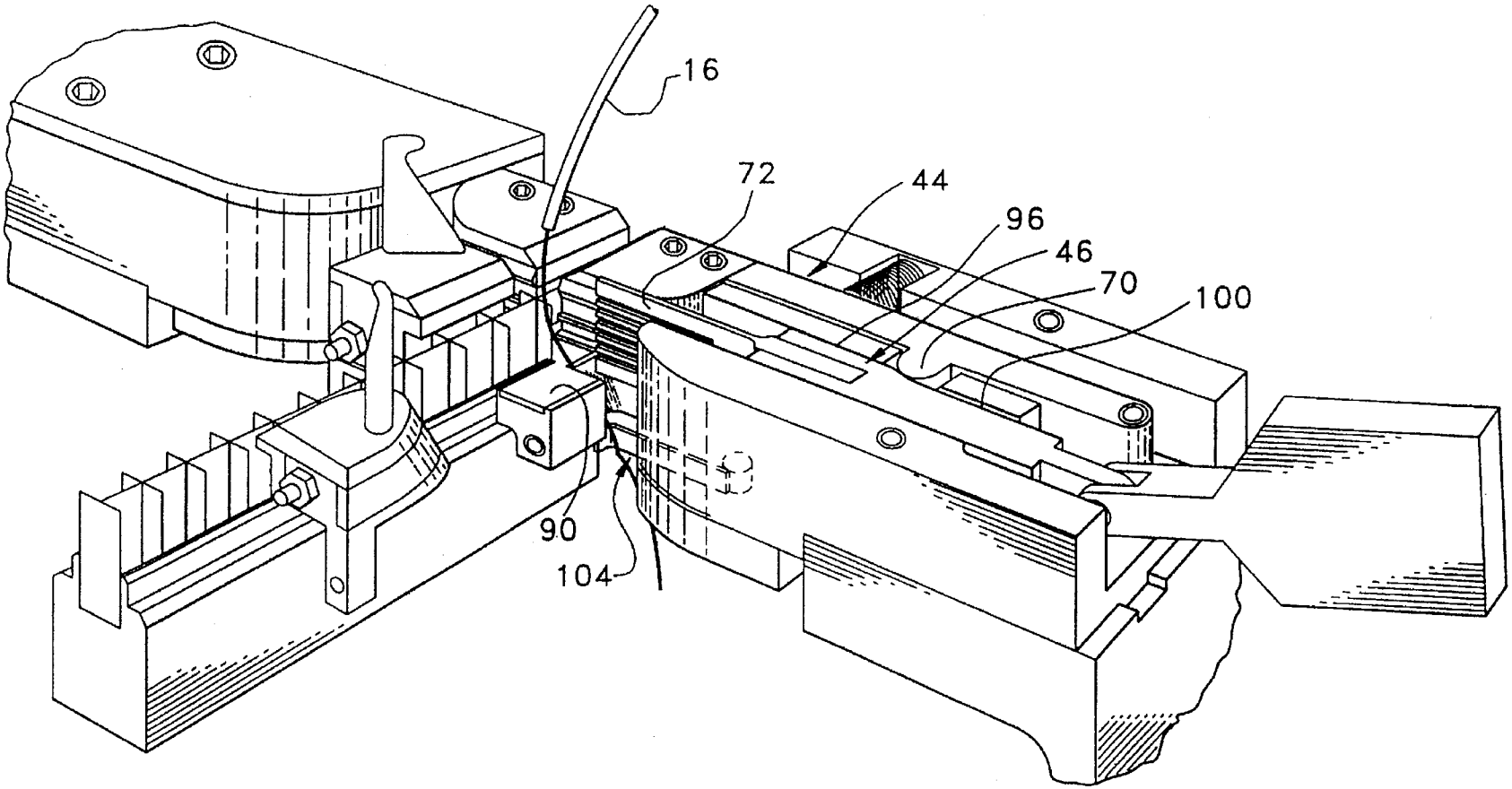
FIGS. 6*a* and 6*b* are similar view to FIGS. 5*a* and 5*b* but showing the wire gripped by the grippers and just prior to termination.
Figure 6B:
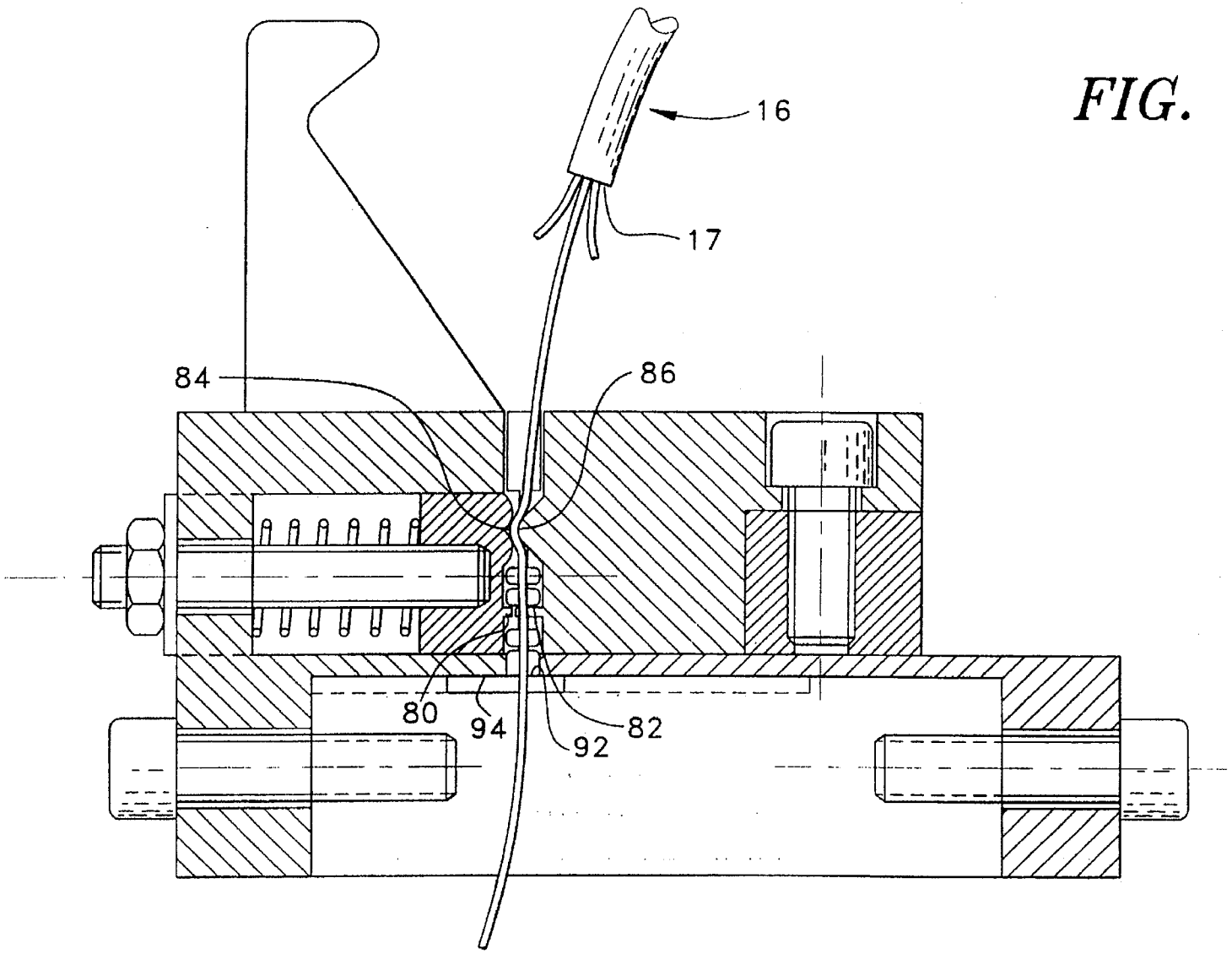
Figure 7A:
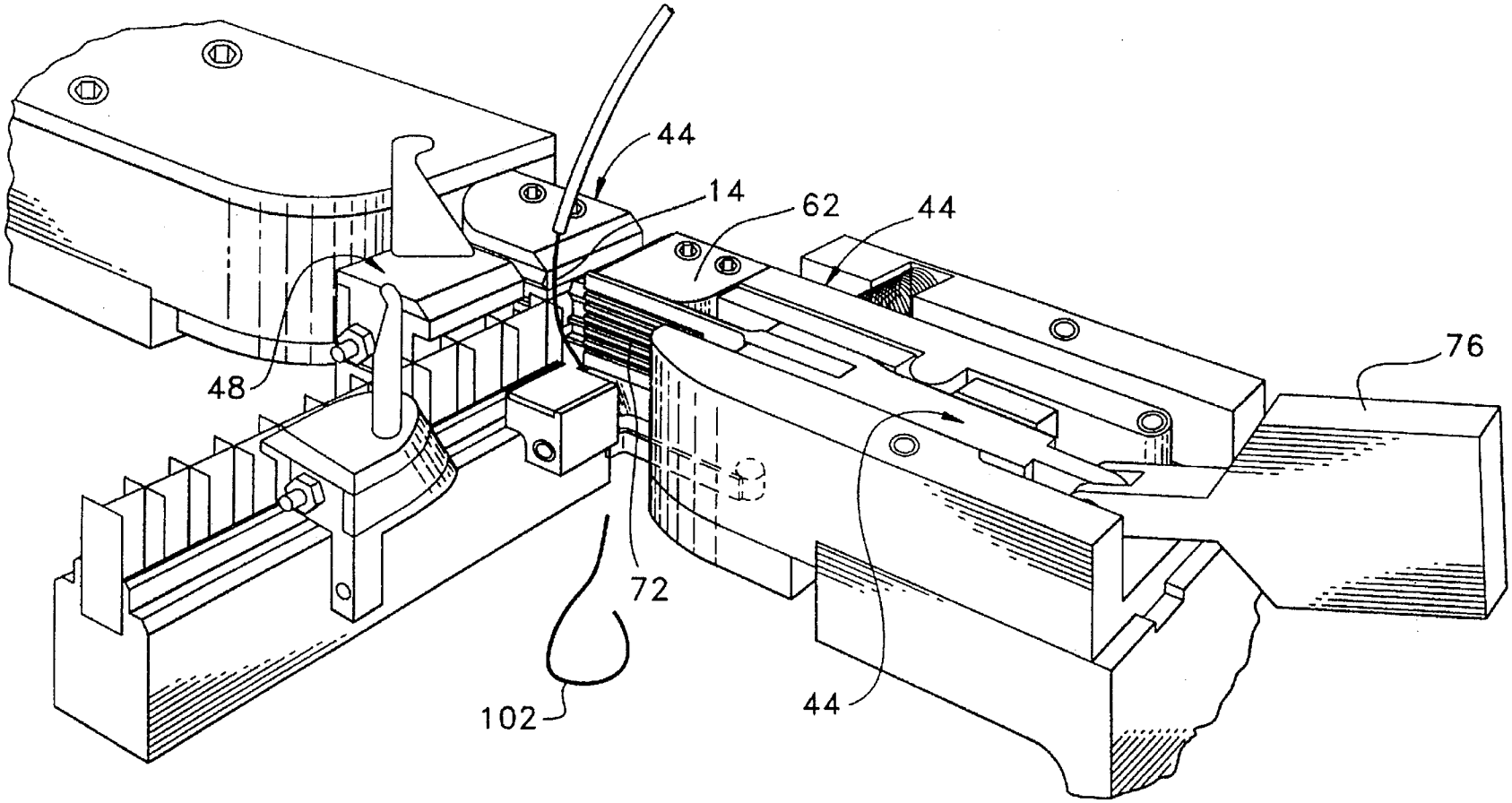
FIGS. 7*a* and 7*b* are similar to FIGS. 6*a* and 6*b* respectively but showing the stuffer in a more advanced position having cut a free end of the wire to be terminated.
Figure 7B:
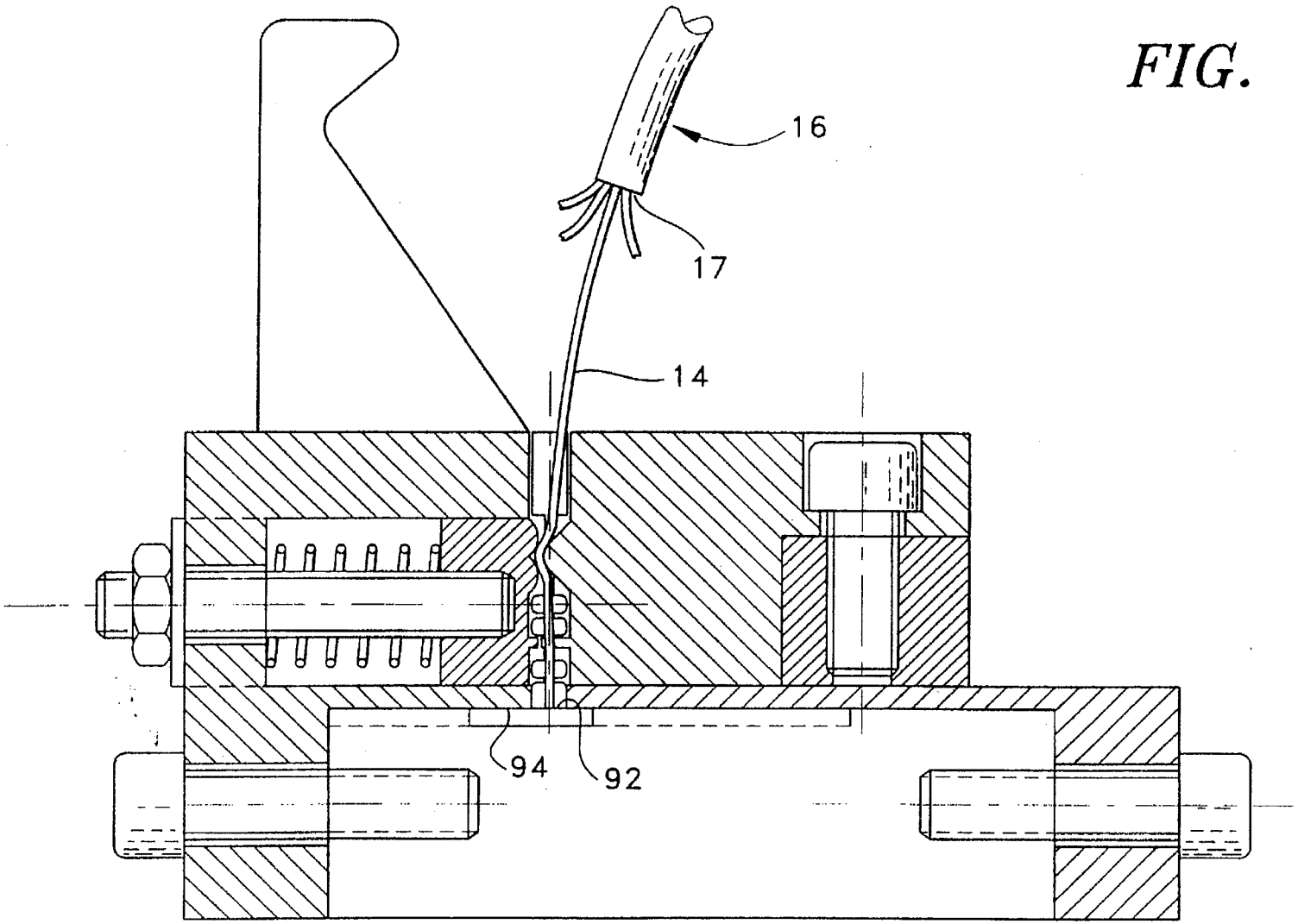
Figure 8A:
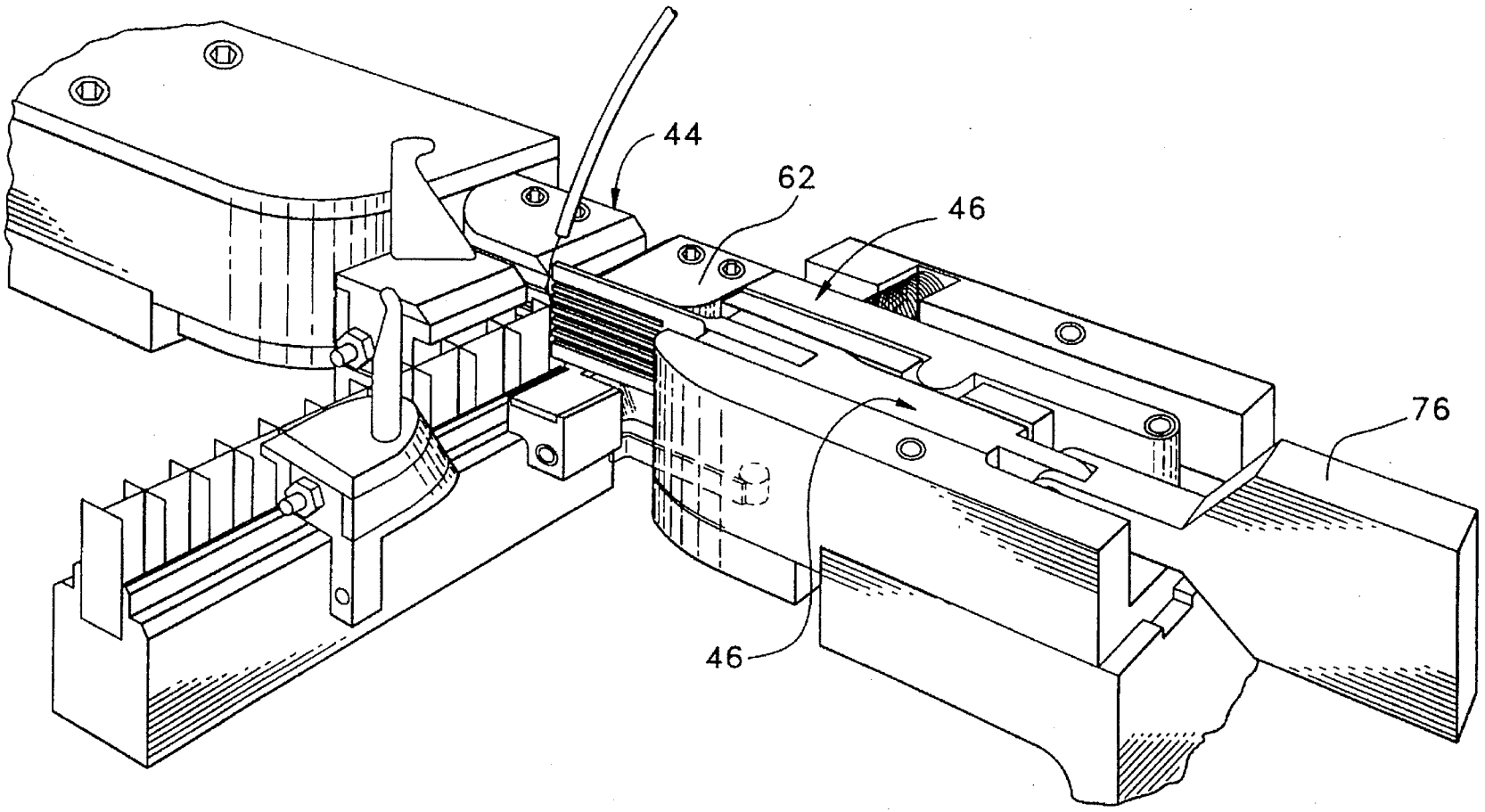
FIGS. 8*a* and 8*b* are similar to FIGS. 7*a* and 7*b* respectively but showing the stuffer in a more advanced position actually stuffing the wire into the IDC slot.
Figure 8B:
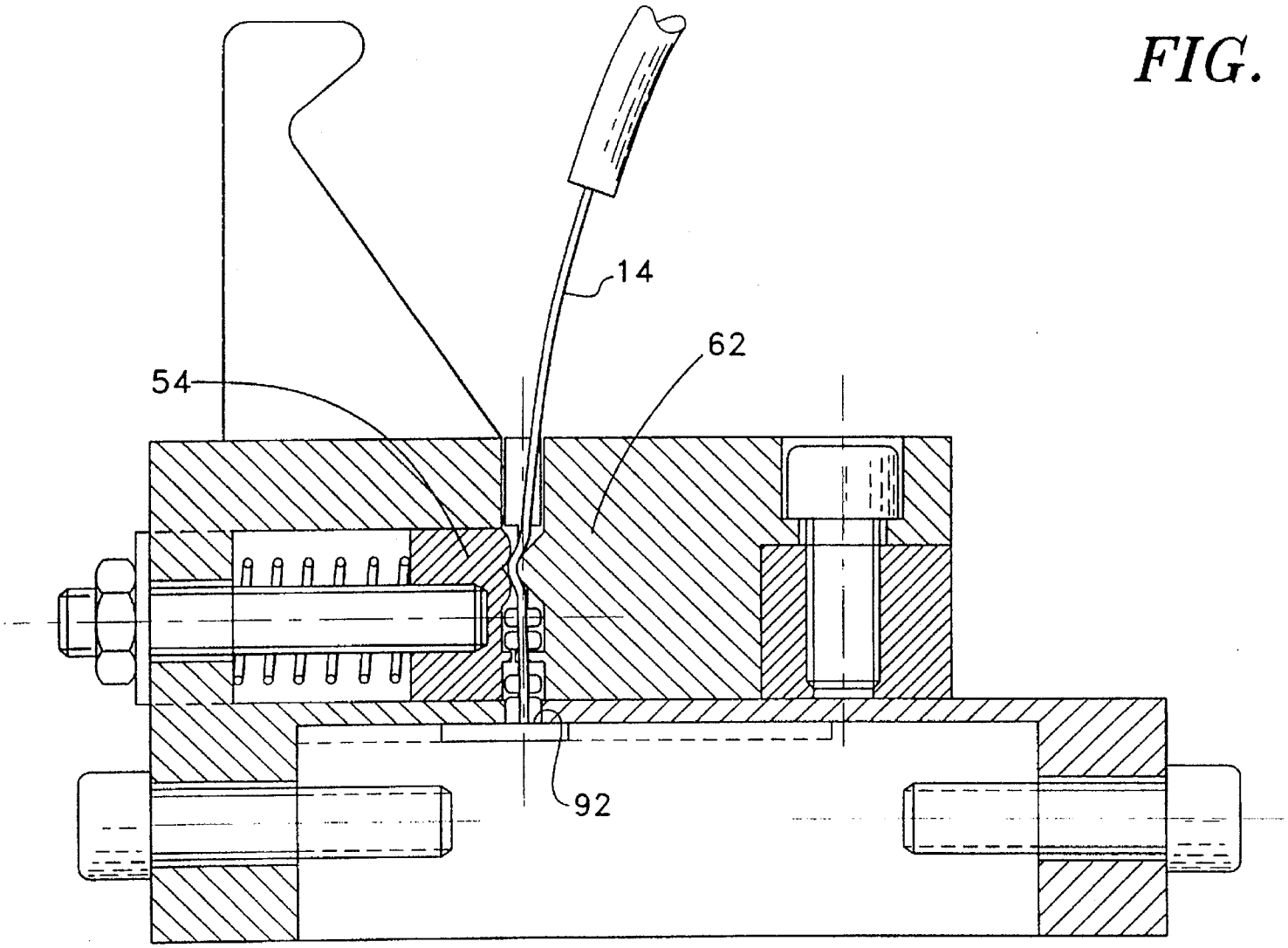

When the wire abuts the cutting edge 92 (FIG. 6*a*), a sensor 104 positioned below the cutting plate 90 detects presence of the wire and activates the stuffer drive motor and linkage 76 such that the stuffer is translated towards the wire. During this movement, and prior to cutting of the wire 14, the recess 100 of the camming plate 74 is positioned opposite the camming protrusion 70 such that the gripper pad 62 clamps the wire 14 against the opposing gripper pad 54 of the stationary member 48 as shown in FIG. 6*b*. The cooperating protrusion and groove 86,84, of the pads 62,54 respectively, kink the wire for a better grip thereof whereby the lower protrusions 80,82 grip and position the wire centrally for accurate insertion into the corresponding IDC slot. Due to the open position of the grippers when pulling the wire between the gripper pads 54,62, the length of wire needed is minimal as the wire can be pulled close to the IDC slot under tension such that the length of wire between a lower end of the cable outer insulation 17 and the IDC section 12 of the connector 2 is as short as possible. Only once the cable is close to the IDC section and under tension, is the stuffer actuated. Just prior to cutting the cable the gripper clamps onto the wire for secure holding thereof in alignment with the IDC section of the terminal to be terminated. As shown in FIGS. 7*a*, 7*b*, further advancement of the stuffer shears the wire by engagement of the stuffer plate lower edge 94 with the cutter plate edge 92. Advance of the stuffer continues until the wire 14 is stuffed into the IDC slots 18 of the terminal 8 as shown in FIG. 8*a*.

The stuffer member then retreats from the connector and the motor and spindle mechanism 26,28 advances the connector support 24 for alignment of the next IDC section to be terminated—the process continuing as described above.

Advantageously therefore, cam actuation of the gripper members 44 by movement of the stuffer member 46 allows the wire 14 to be terminated to be brought under tension as close as possible to the connector 2 prior to termination, where the movement of the stuffer causes engagement of the gripper against the wire prior to cutting and termination. The latter thus ensures IDC termination with the shortest possible use of wire extending from the cable 16 by a machine with a cost-effective and reliable construction.

We claim:

1. An IDC termination machine for terminating wires of a cable to IDC sections of a connector, the machine comprising a connector support for holding the connector thereon, a stuffer having a stuffer plate for stuffing the wires into the connector IDC sections, and a gripper mechanism having opposed gripper pads for holding and positioning a wire proximate the connector prior to termination, the stuffer being movable from a retreat position in which the wire can be positioned between the gripper pads to an advanced position where the stuffer plate is positioned between gripper pads and the wire is terminated to the IDC section, the stuffer being movable transversely to a direction of clamping of the gripper pads wherein the stuffer comprises a camming surface engageable with the gripper mechanism to separate the gripper pads in the retreat position for unhindered tensioning of the wire therebetween, the camming surface moving the gripper pads toward each other in the direction of clamping, thereby enabling clamping of the wire by the gripper pads when the stuffer is proximate the advance position.

2. The machine of claim 1 wherein one of the gripper pads is attached to an arm.

3. The machine of claim 2 wherein the arm is pivotly mounted to the machine.

4. The machine of claim 3 wherein the arm has a camming member biasable against the stuffer camming surface.

5. The machine of claim 4 wherein the camming member is a protrusion, and the camming surface transitions from a bulge to a recess to define respectively the open and clamped positions of the gripper mechanism.

6. The machine of claims 2, 3, 4 or 5 wherein the arm extends substantially alongside the stuffer.

7. The machine of claim 1 wherein the stuffer is an elongated plate member where the camming surface extends between the stuffer plate and a drive mechanism that moves the stuffer.

8. The machine of claim 7 wherein the stuffer plate is guided laterally by guide surfaces below the gripper pads to provide bending stability during stuffing of the wire into the connector IDC section.

9. The machine of claim 1 wherein the one of the gripper pads is resiliently biased towards the opposed gripper pad.

10. The machine of claim 9 wherein both of the gripper pads are resiliently biased towards each other.

* * * * *